US007818900B2

(12) United States Patent
Cavasin

(10) Patent No.: US 7,818,900 B2
(45) Date of Patent: Oct. 26, 2010

(54) INNER BOOT, PARTICULARLY FOR A SPORTS SHOE

(75) Inventor: Massimo Cavasin, Montebelluna (IT)

(73) Assignee: Roces S.R.L., Montebelluna (IT)

( * ) Notice: Subject to any disclaimer, the term of this patent is extended or adjusted under 35 U.S.C. 154(b) by 908 days.

(21) Appl. No.: 11/606,042

(22) Filed: Nov. 30, 2006

(65) Prior Publication Data

US 2007/0151123 A1 Jul. 5, 2007

(30) Foreign Application Priority Data

Dec. 29, 2005 (IT) ..... TV2005A0203

(51) Int. Cl.
*A43B 3/26* (2006.01)
*A43B 5/04* (2006.01)

(52) U.S. Cl. ..... 36/97; 36/10; 36/117.6

(58) Field of Classification Search ..... 36/97, 36/10, 54, 45, 117.6
See application file for complete search history.

(56) References Cited

U.S. PATENT DOCUMENTS

| | | | | |
|---|---|---|---|---|
| 1,974,543 | A * | 9/1934 | Reymond | 36/45 |
| 4,268,931 | A | 5/1981 | Salomon | |
| 4,562,652 | A * | 1/1986 | Hensler | 36/102 |
| D300,049 | S * | 2/1989 | Klamer et al. | D21/763 |
| 4,893,417 | A * | 1/1990 | Dalla Lana | 36/10 |
| 6,276,697 | B1 * | 8/2001 | Lin | 280/11.26 |
| D460,605 | S * | 7/2002 | Whittington | D2/902 |
| 6,438,872 | B1 * | 8/2002 | Chil et al. | 36/97 |
| 6,701,643 | B2 * | 3/2004 | Geer et al. | 36/97 |
| 2001/0005948 | A1 * | 7/2001 | Pellegrini, Jr. et al. | 36/117.7 |
| 2002/0170206 | A1 * | 11/2002 | Chil et al. | 36/97 |

FOREIGN PATENT DOCUMENTS

| | | |
|---|---|---|
| EP | 0 308 368 A1 | 3/1989 |
| FR | 2 358 117 A | 2/1978 |
| GB | 690 660 A | 4/1953 |
| WO | WO 98/06286 A | 2/1998 |

* cited by examiner

*Primary Examiner*—John T. Kavanaugh
(74) *Attorney, Agent, or Firm*—Modiano & Associati; Albert Josif; Daniel J. O'Byrne

(57) ABSTRACT

Inner boot, particularly for a sports shoe such as a ski boot, an in-line roller skate or an ice skate, comprising a front portion, that covers the toes and part of the forefoot of the user, and a rear portion, that extends at the region of the plantar's arch up to the heel; the front portion is connected to the rear portion by way of one or more interconnection bellows having, in a rest position, its maximum elongation.

9 Claims, 6 Drawing Sheets

INNER BOOT, PARTICULARLY FOR A SPORTS SHOE

The present invention relates to an inner boot with variable length, particularly for a sports shoe such as a ski boot, an in-line roller skate, or an ice skate.

BACKGROUND OF THE INVENTION

There are currently in use ski boots and in-line roller skates whose extension of the shell may be slightly modified by the user, for example for better adapting to his/her particular morphological characteristics, or for allowing to provide a size change per being worn by a plurality of users having feet of different sizes.

Such boots and in-line skates usually comprise a shell, provided in rigid or semi-rigid material, constituted by a front portion, extending at the region of the forefoot, and by a contiguous rear portion, extending at the region of the heel, whose mutual distance may be modified by the user by means of appropriate adjustment means, so as to change the length of the shell.

To the shell there is in general associated an inner boot, removable therefrom, provided in soft material, adapted to increase the comfort-fit of the user.

A problem that arises when one wishes to obtain a size change consists in the fact that the inner boot must also be able to be deformed.

In this regard, EP-1 066 862 discloses an in-line skate with variable length provided with an inner boot whose length may in turn change, being constituted by a front portion, that substantially covers the toes of the user, and by a rear portion, that extends at the region from the plantar's arch up to the heel, mutually interconnected by a band provided in an elastically deformable material.

When the inner boot is in a rest position the band is non-deformed and has its minimum extension, which corresponds therefore to the condition of minimum length of the inner boot and of the shell.

In the case in which the length of the shell has been modified and is greater than that of the inner boot in the condition of minimum length, the deformability of the band allows the inner boot to adapt itself to the various sizes of the foot of the user.

Such inner boots of the known type have however a drawback: in fact the band of elastically deformable material tends to elastically return in its non-deformed condition, pulling the front portion towards the rear portion and exerting therefore a compression on the tip of the foot of the user, so as to compromise the comfort-fit.

Moreover, the band of elastically deformable material may, with use, lose its elastic characteristics and permanently deform, thus compromising the fit-comfort thereof.

SUMMARY OF THE INVENTION

The aim of the present invention is to solve the above mentioned problems, eliminating the drawbacks of the cited prior art, by providing an inner boot for a sports shoe whose extension is adjustable, so as to improve the comfort-fit for the user.

Within this aim, an object of the invention is to provide an inner boot that may be used in conjunction with a known ski boot or roller skate or ice skate having variable length.

Another object is to provide an inner boot that is structurally simple, and has low production costs.

This aim and these and other objects, that will appear clearer hereinafter, are achieved by an inner boot, particularly for a sports shoe such as a ski boot, an in-line roller skate or an ice skate, comprising a front portion, that covers the toes and part of the forefoot of the user, and a rear portion, that extends at the region from the plantar's arch up to the heel, that is characterized by the fact that said front portion is connected to said rear portion by way of one or more bellows interconnection means having, in a rest position, its maximum elongation.

BRIEF DESCRIPTION OF THE DRAWINGS

Further characteristics and advantages of the invention will become better apparent from the following detailed description of a preferred but not exclusive embodiment thereof, illustrated only by way of non-limiting example in the accompanying drawings, in which.

DESCRIPTION OF THE PREFERRED EMBODIMENTS

Figure 1:
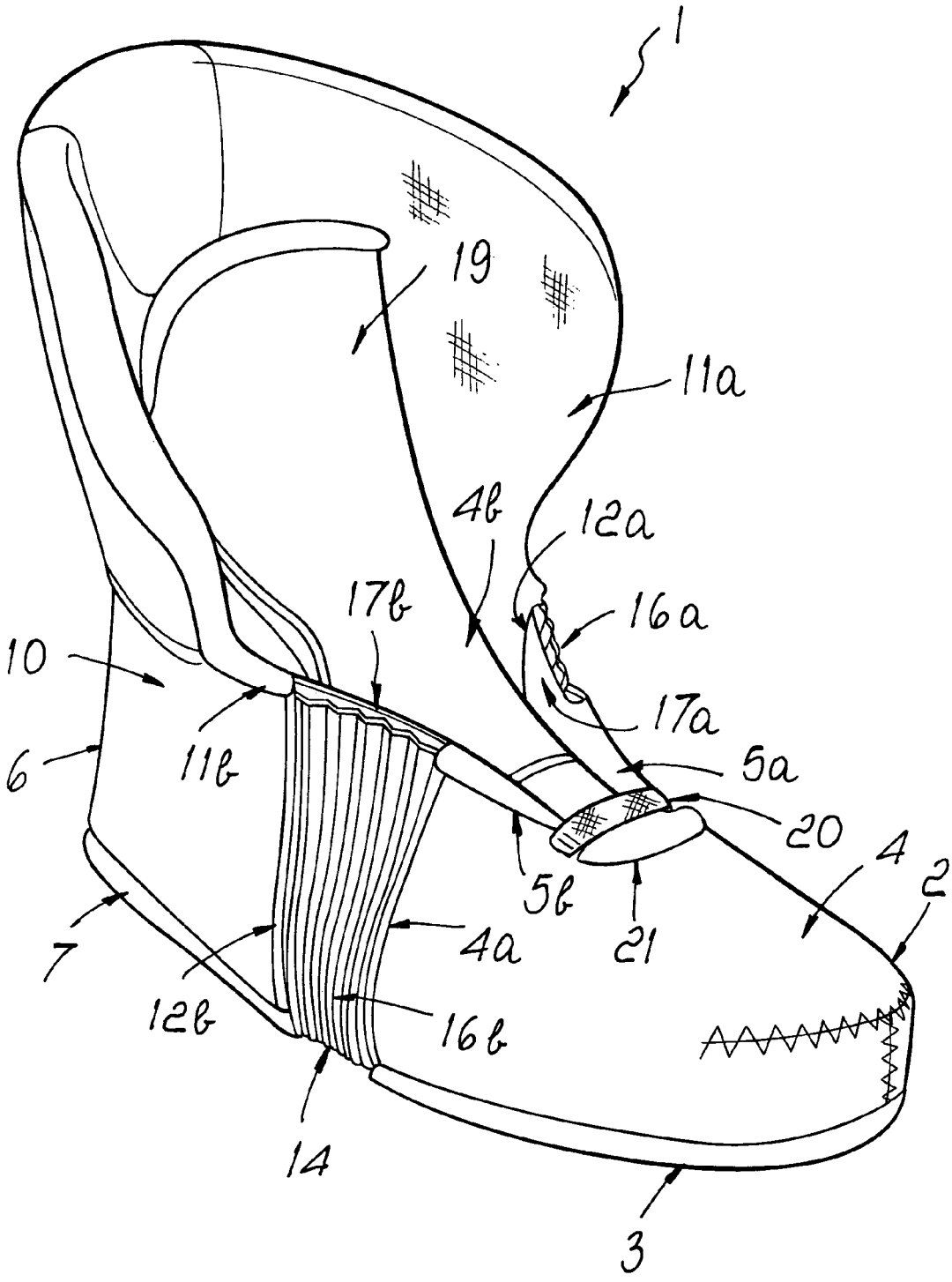
FIG. 1 is a perspective view of an inner boot according to the invention.
Figure 2:
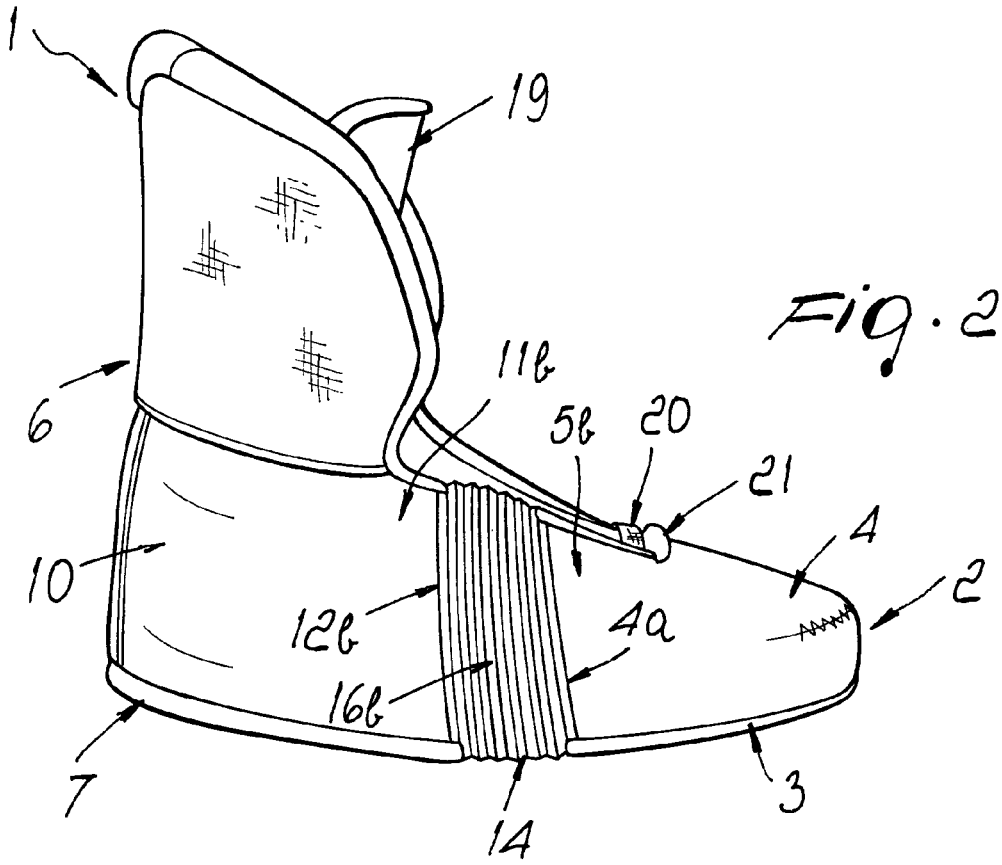
FIGS. 2 and 3 are side views of the inner boot of FIG. 1 in the conditions of maximum and minimum extension, respectively.
Figure 3:
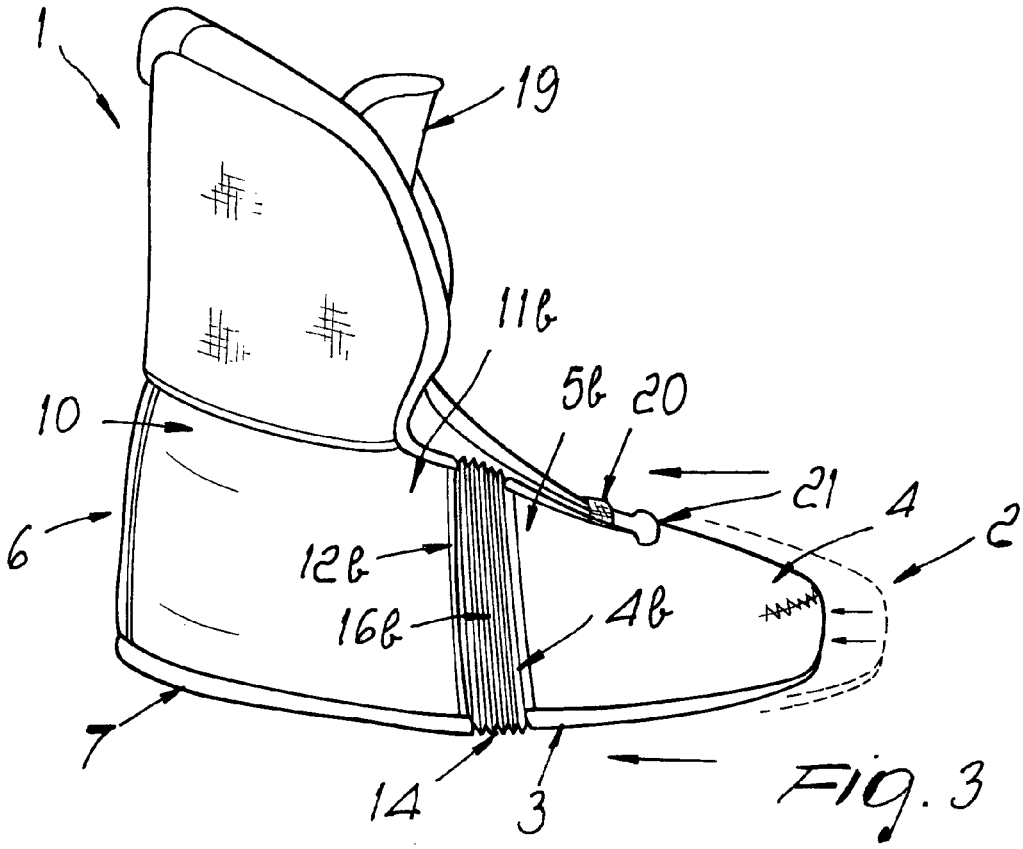
Figure 4:
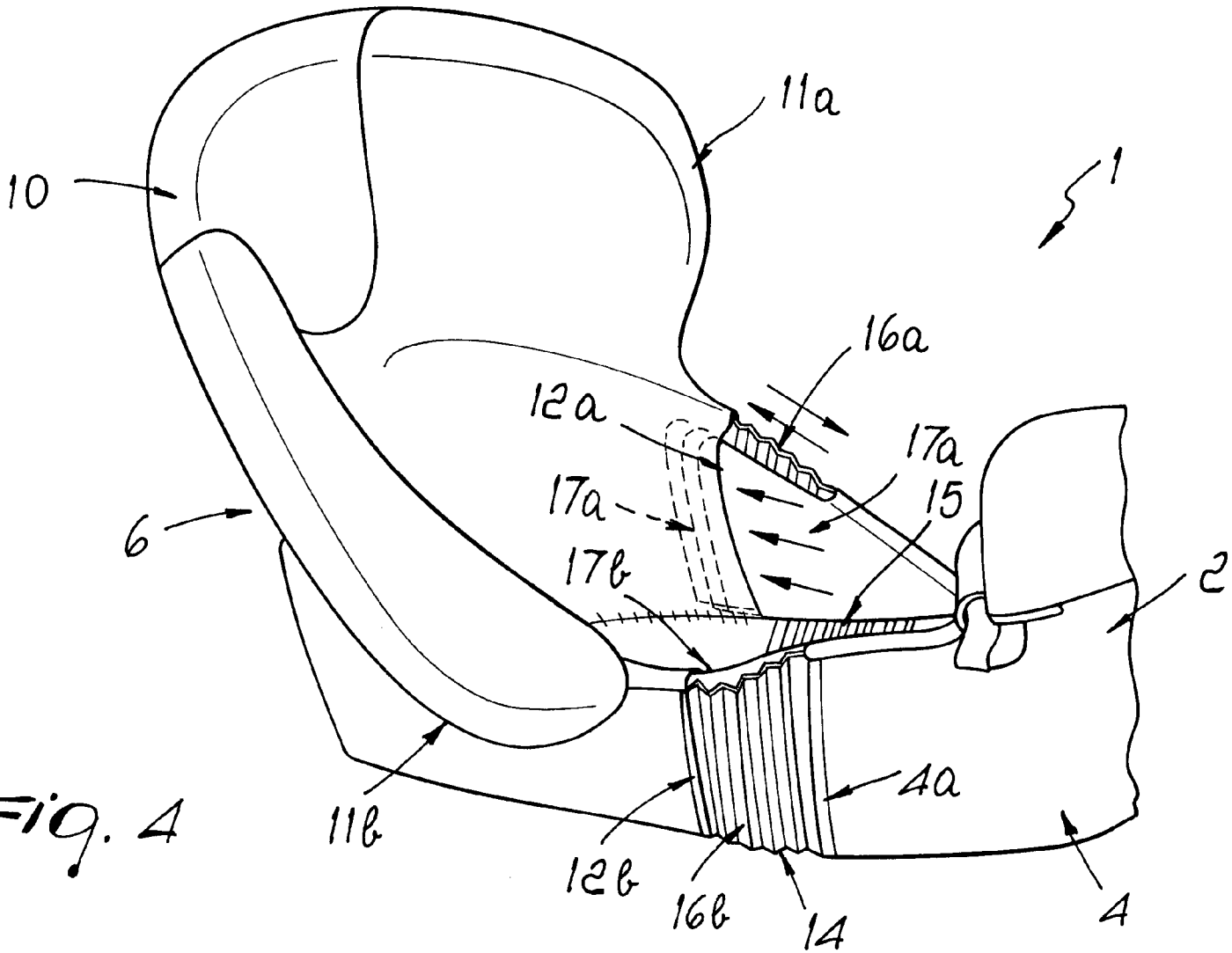
FIG. 4 is a perspective view of a detail of FIG. 1.
Figure 6:
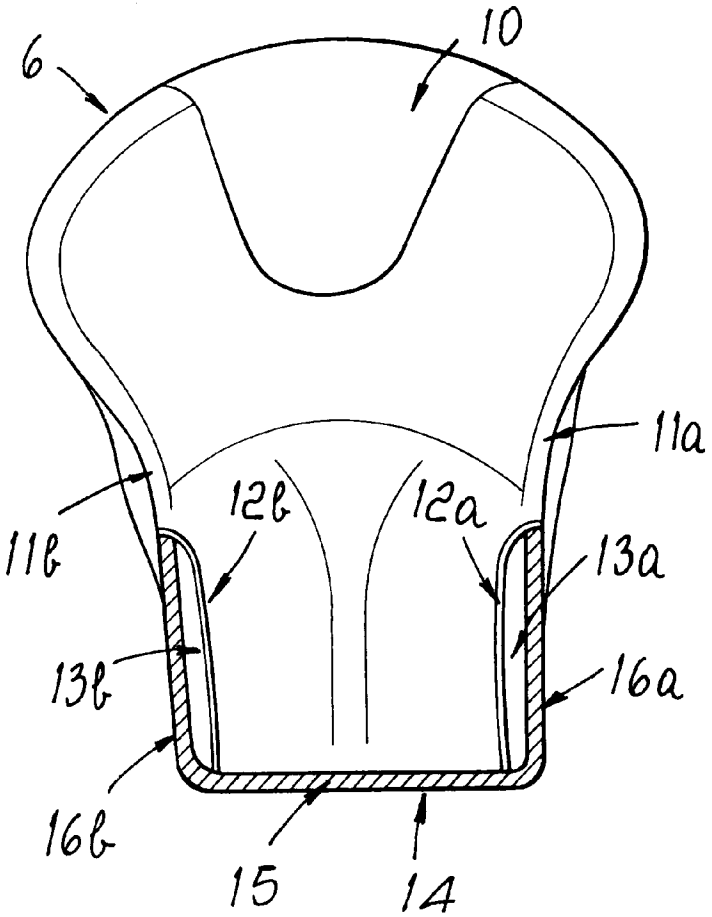
FIG. 6 is a view of the inner boot, similar to the preceding one, in which the appendices are not shown.
Figure 5:
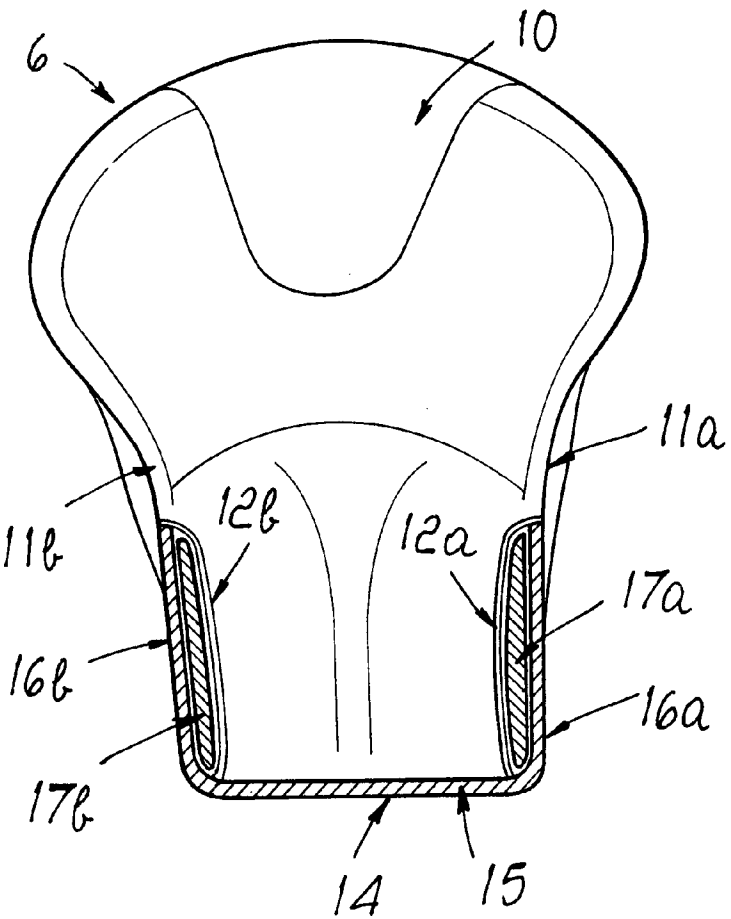
FIG. 5 is a sectional view of the inner boot taken along a transverse plane.
Figure 7:
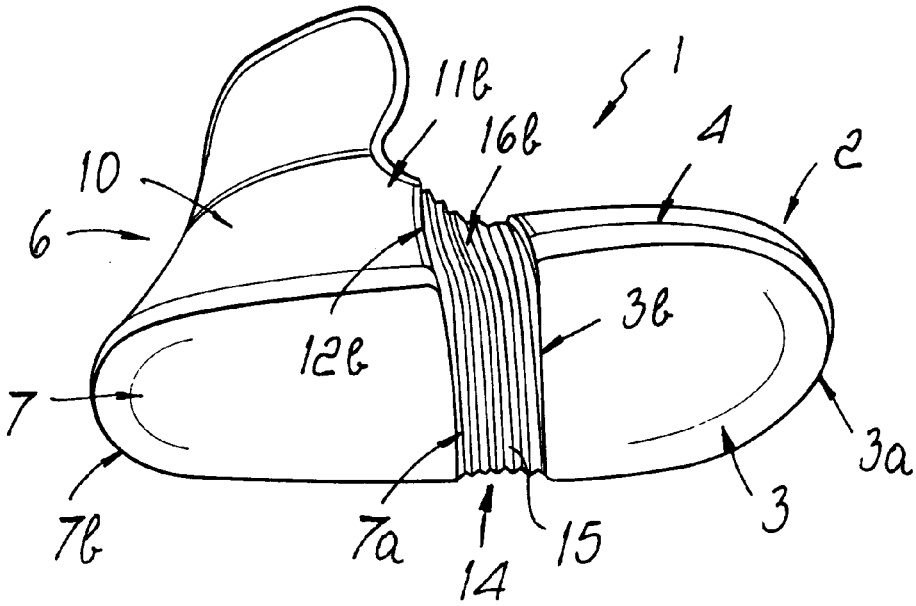
FIG. 7 is a perspective view from below of the inner boot of FIG. 1.
Figure 8:
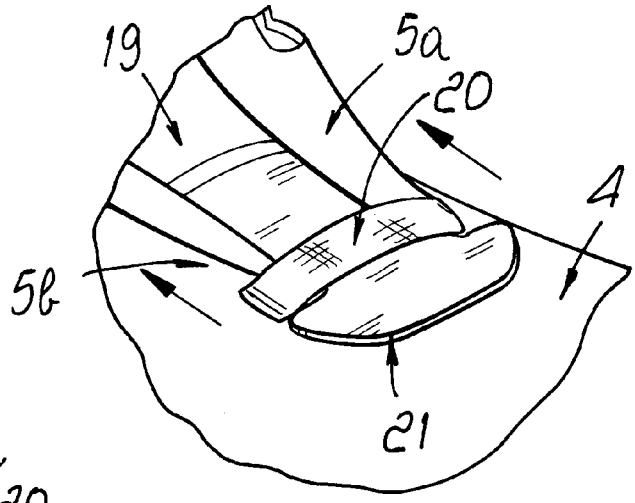
FIGS. 8 and 9 are detail views of the tongue of the inner boot of FIG. 1, in two different use conditions.
Figure 9:
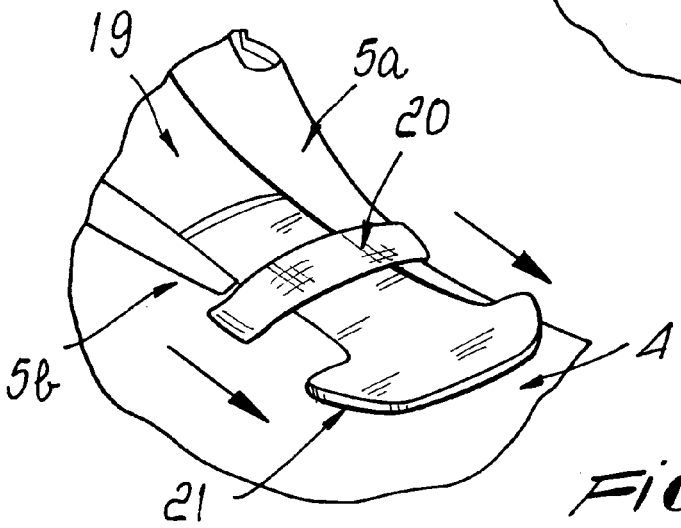

In the following embodiments, single characteristics, in relation to specific embodiments, in reality may be interchanged with other different characteristics, existing in other embodiments.

Moreover, it is to be noted that everything found to be known during the patenting procedure is not intended to be claimed and subject to a disclaimer from the claims.

With reference to the figures, the reference numeral 1 indicates an inner boot, particularly for a sports shoe, such as a ski boot, an in-line roller skate or ice skate, not shown in the attached drawings.

The inner boot 1 comprises a front portion 2 that covers the toes and part of the forefoot of the user.

The front portion 2, preferably provided in soft material, has an open box-like shape and is constituted by a first bottom 3, approximately flat and shaped in plan view substantially as a semi-circle, upon which, in use, the toes and part of the forefoot of the user rest; from the perimetral edge of the first bottom 3, having a first curved front portion 3*a*, there protrudes, with exception to a first rear straight portion 3*b*, a first covering element 4, having an arcuate profile, that covers, in use, the toes and part of the forefoot of the user.

Advantageously the first covering element 4 has, on the perimetral border or edge and opposite the tip of the foot, an opening 4*b*, arranged approximately along a medium longitudinal axis of the inner boot 1, that defines two first flaps, indicated respectively with the reference numerals 5*a* and 5*b*, substantially mutually facing and advantageously mutually distanced.

The inner boot 1 further comprises a rear portion 6, having an open box-like shape, provided in soft material, that is arranged at the area of the plantar's arch and of the heel, the latter extending up to partially wrap around the rear part of the tibia of the user; such rear portion 6 is constituted by a second bottom 7, that is approximately flat and whose perimetral border or edge has a rounded shape upon which, in use, the heel of the user rests.

The perimetral border or edge of the second bottom 7 has a second front flat or straight portion 7*a*, and a second rear curved portion 7*b*, from which there protrudes a second covering element 10 that is arranged at the area of the heel and extends up to partially wrap around and rearwardly the tibia of the user.

The second covering element 10 is upwardly and forwardly open for allowing access to the foot of the user, and has two second flaps, indicated respectively with the numbers 11*a* and 11*b*, that are approximately mutually parallel and spaced.

At the first vertical borders 12*a* and 12*b* of the second flaps 11*a* and 11*b* facing, in use, the first flaps 5*a* and 5*b* of the first covering element 4, there are provided, with an axial extension and towards the inside of the inner boot 1, two seats, indicated respectively with the numbers 13*a* and 13*b*, extending at and along such first vertical borders 12*a* and 12*b* for substantially their entire height.

The rear portion 6 is connected to the front portion 2 by means of one or more bellows interconnection means having, in a rest position, its maximum elongation.

Advantageously the above cited one or more bellows interconnection means are constituted by a bellows band 14 that has, in a rest position, its maximum elongation, this latter being able to be reduced under a compression in a transverse direction of the bellows band 14, thereby to compact it upon itself.

The bellows band 14 is advantageously folded substantially with a U-shaped configuration, i.e. having the overall shape of a U-element, to define a substantially flat base 15 that is connected, at its longitudinal ends, respectively to the first rear portion 3*b* of the first bottom 3 and to the second front portion 7*b* of the second bottom 7.

In the base 15 there are provided, substantially perpendicularly, two wings, indicated with the numbers 16*a* and 16*b*, that are connected respectively to the external perimetral border of the seats 13*a* and 13*b* provided in the second flaps 11*a* and 11*b* of the second covering element 10, and to the second vertical borders 4*a* of the first covering element 4.

Advantageously the bellows band 14 is provided in plastic material.

Advantageously to each of the second vertical borders 4*a* of the first covering element 4 there are associated (or there protrude) two appendices, indicated respectively with the numbers 17*a* and 17*b*, that extend in the direction of the rear portion 6 and are positioned, partially and in a slide-able manner, within the seats 13*a* and 13*b*.

Advantageously the inner boot 1 comprises a small tongue 19, provided in soft material, with an end slide-ably connected to the front portion 2 in the area adjacent the two first flaps 5*a* and 5*b*.

Advantageously the position of the tongue 19 may be adjusted by the user by way of an appropriate guiding means advantageously constituted by a small band 20 whose ends are connected to the upper surface of the first covering element 4, preferably in proximity to the area of connection of the first flaps 5*a* and 5*b*.

Between the band 20 and the first covering element 4 there is slide-ably connected the lower end 21 of the tongue 19, that has in plan view an approximately T-shaped configuration, adapted to abut with the band 20 to prevent its extraction.

The use of the invention is therefore the following: with reference to the attached drawings, the inner boot 1 may be inserted in the shell of a sport shoe such as a ski boot or an in-line roller skate or an ice skate of the known type having an adjustable length, not shown in the attached drawings.

As described above, the bellows band 14 has, in a rest position, its maximum elongation; its insertion into a shoe of shorter length is allowed due to compacting of the bellows band 14.

By increasing the length of the shell of the ski boot or of the skate, the bellows band 14 tends to return to its length of rest position, allowing the elongation of the inner boot 1 according to the invention.

The position of the tongue 19 may further be modified by means of a simple pulling of the free end thereof, so as to make the lower end 21 thereof slide between the band 20 and the first covering element 4.

It is seen therefore how the invention has achieved the proposed aim and objects, there being provided an inner boot that, thanks to the possibility of changing its length, is capable of being used together with a ski boot or skate having variable length, guaranteeing a high comfort-fit to the user.

Moreover, the inner boot according to the invention, having its maximum length in the rest position, may be adapted to the foot of the user without compressing it, increasing the comfort-fit with respect to known types of elongatable inner boots.

Moreover, the bellows band, compacting upon itself in the condition of minimum length of the inner boot, does not protrude towards the foot of the user, guaranteeing even more the comfort thereof.

Moreover the production costs of the inner boot according to the invention are maintained low, being obtained only with components that are easy to produce and/or assemble.

Figure 10:
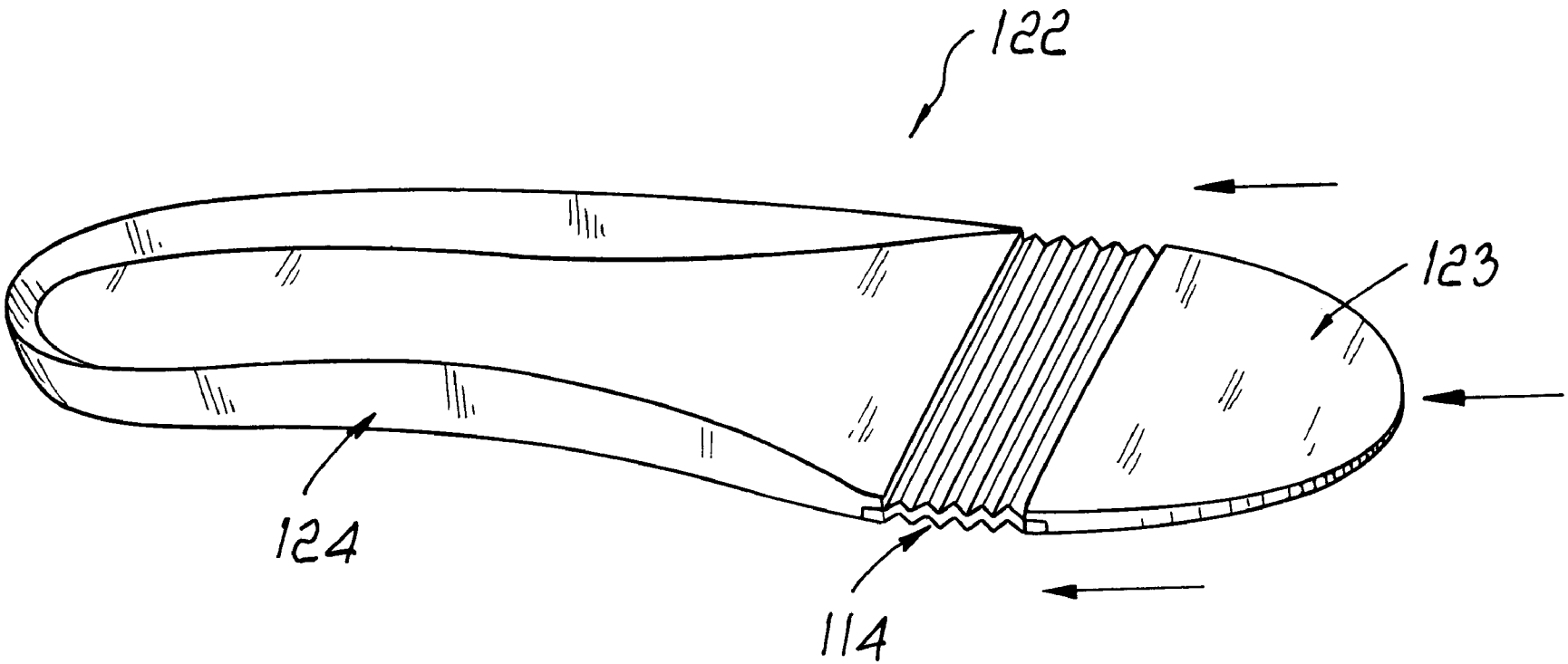
FIG. 10 is a perspective view of an arch support associable with the inner boot according to the invention.

Of course the invention is susceptible to numerous modifications and variations, all of which fall within the scope of the appended claims. For example, in FIG. 10 there is illustrated an arch support 122 for footwear, made in accordance with the invention, constituted by a front portion 123, for supporting the toes and eventually part of the forefoot, interconnected by means of at least one bellows interconnection means, for example the bellows band 114, to a rear portion 124, for supporting the plantar's arch and the heel.

The bellows band 114, and therefore the arch support 122, have, in a rest configuration, their maximum elongation; such arch support 122 may therefore be inserted in a footwear of shorter length thanks to the compacting of the bellows band 114.

The inner boot 1 and arch support 122, of the invention, may be used together for a same shoe.

The term substantially, as herein used, is intended to mean that the features to which it refers have the characteristics indicated, but for normal tolerances known to the one skilled in the art.

The materials employed as well as the dimensions constituting the singular components of the invention may be more pertinent according to specific requirements.

The different means for carrying out certain different functions certainly do not have to exist only in the illustrated embodiment, but may be per se present in many embodiments, also not illustrated.

The characteristics indicated as advantageous, opportune or similar, may also be not present or substituted by equivalents.

The disclosures in Italian Patent Application No. TV2005A000203 from which this application claims priority are incorporated herein by reference.

What is claimed is:

1. An inner boot for a sports shoe, comprising:

a front portion, suitable to cover toes and part of a forefoot of a user;

a rear portion, that extends at a region of a plantar's arch up to a heel of the user; and a bellows band that interconnects said front portion to said rear portion, said bellows band being folded substantially with a U-shaped configuration extending from sides of the inner boot and below the inner boot and having, in a rest position of the bellows band, a maximum elongation thereof.

2. The inner boot of claim 1, wherein said bellows band has, in the rest position, a maximum elongation thereof, the maximum elongation being reducible under a compression in a transverse direction of said bellows band, thereby to compact the bellows band upon itself.

3. The inner boot of claim 2, wherein said bellows band is made of plastic material.

4. The inner boot of claim 1, wherein said front portion has an open box-like shape and is constituted by a first bottom having a first front curved portion provided with a front covering element that protrudes from the curved portion, with the exception of a first rear straight portion, said first covering element of an arcuate profile having, on a perimetral border thereof opposite to the front portion, an opening having two first laps, said rear portion comprising a second bottom, with a perimetral border having a second front straight portion and a second rear portion provided with a second covering element protruding therefrom, said second covering element being upwardly and forwardly open to define two second flaps substantially mutually parallel and spaced, said first vertical borders of said second flaps facing, in use, towards said first flaps of said first covering element, being provided with two seats having an axial extension towards an inside part of said inner boot, said two seats extending along said first vertical borders for substantially their entire height.

5. An inner boot for a sports shoe, comprising:

a front portion, suitable to cover toes and part of a forefoot of a user;

a rear portion, that extends at a region of a plantar's arch up to a heel of the user; and at least one bellows interconnection means for connecting said front portion to said rear portion, said at least one bellows interconnection means having, in a rest position, a maximum elongation thereof;

said front portion having an open box-like shape and being constituted by a first bottom having a first front curved portion provided with a front covering element that protrudes from the curved portion, with the exception of a first rear straight portion, said first covering element of an arcuate profile having, on a perimetral border thereof opposite to the front portion, an opening having two first flaps, said rear portion comprising a second bottom, with a perimetral border having a second front straight portion and a second rear portion provided with a second covering element protruding therefrom, said second covering element being upwardly and forwardly open to define two second flaps substantially mutually parallel and spaced, said first vertical borders of said second flaps facing, in use, towards said first flaps of said first covering element, being provided with two seats having an axial extension towards an inside part of said inner boot, said two seats extending along said first vertical borders for substantially their entire height; and said bellows band being folded in a substantially U-shaped configuration to define a substantially flat base connected, at longitudinal ends thereof, respectively to said first rear portion of said first bottom and to said second front portion of said second bottom.

6. The inner boot of claim 5, comprising two wings provided substantially perpendicularly to said base and connected, respectively, to an external perimetral border of said two seats of said second flaps and to the second vertical borders of said first covering element.

7. The inner boot of claim 6, comprising two appendices that extend in the direction of said rear portion and are positioned, partially and in a slide-able manner, within said seats, said appendices being associated with or protruding from each of said second vertical borders of said first covering element.

8. The inner boot of claim 7, comprising a small tongue, made of soft material, with an end slide-ably connected to said front portion in an area adjacent said two first flaps.

9. An arch support for footwear in combination with the inner boot according to claim 1, said arch support being constituted by a front portion, by a rear portion for supporting a plantar's arch and a heel of a user and by bellows band, said front portion for supporting toes of the user and part of a forefoot thereof, said at least one bellows interconnection means for providing interconnection between the front portion and the rear portion.

* * * * *